US006197421B1

(12) United States Patent
Yamamoto et al.

(10) Patent No.: US 6,197,421 B1
(45) Date of Patent: Mar. 6, 2001

(54) CARBON FIBER-REINFORCED RESIN COMPOSITION

(75) Inventors: Iwao Yamamoto; Akihiko Yoshiya, both of Sakaide; Tadahiro Nishimoto, Yokohama, all of (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 09/520,998

(22) Filed: Mar. 8, 2000

Related U.S. Application Data

(62) Division of application No. 08/678,047, filed on Jul. 1, 1996.

(30) Foreign Application Priority Data

Jul. 14, 1995 (JP) ..... 7-178446
Oct. 3, 1995 (JP) ..... 7-256104

(51) Int. Cl.[7] ..... D02G 3/00

(52) U.S. Cl. ..... 428/361
(58) Field of Search ..... 428/361

(56) References Cited

U.S. PATENT DOCUMENTS 3,921,874 * 11/1975 Spain .

FOREIGN PATENT DOCUMENTS 0 308 929 * 3/1989 (EP) .
52 074 029 * 6/1977 (JP) .
3-126608 * of 1991 (JP) .

* cited by examiner

*Primary Examiner*—Edward J. Cain
(74) *Attorney, Agent, or Firm*—Nixon & Vanderhye

(57) ABSTRACT

A short carbon fiber bundling mass is disclosed, which can provide a high-modulus fiber-reinforced resin composition and comprises short carbon fibers bundled by using a sizing agent and heated to a maximum temperature ranging from 1,600° C. to 3,300° C. in an inert gas atmosphere so as to be graphitized.

14 Claims, 1 Drawing Sheet

CARBON FIBER-REINFORCED RESIN COMPOSITION

Figure 1:
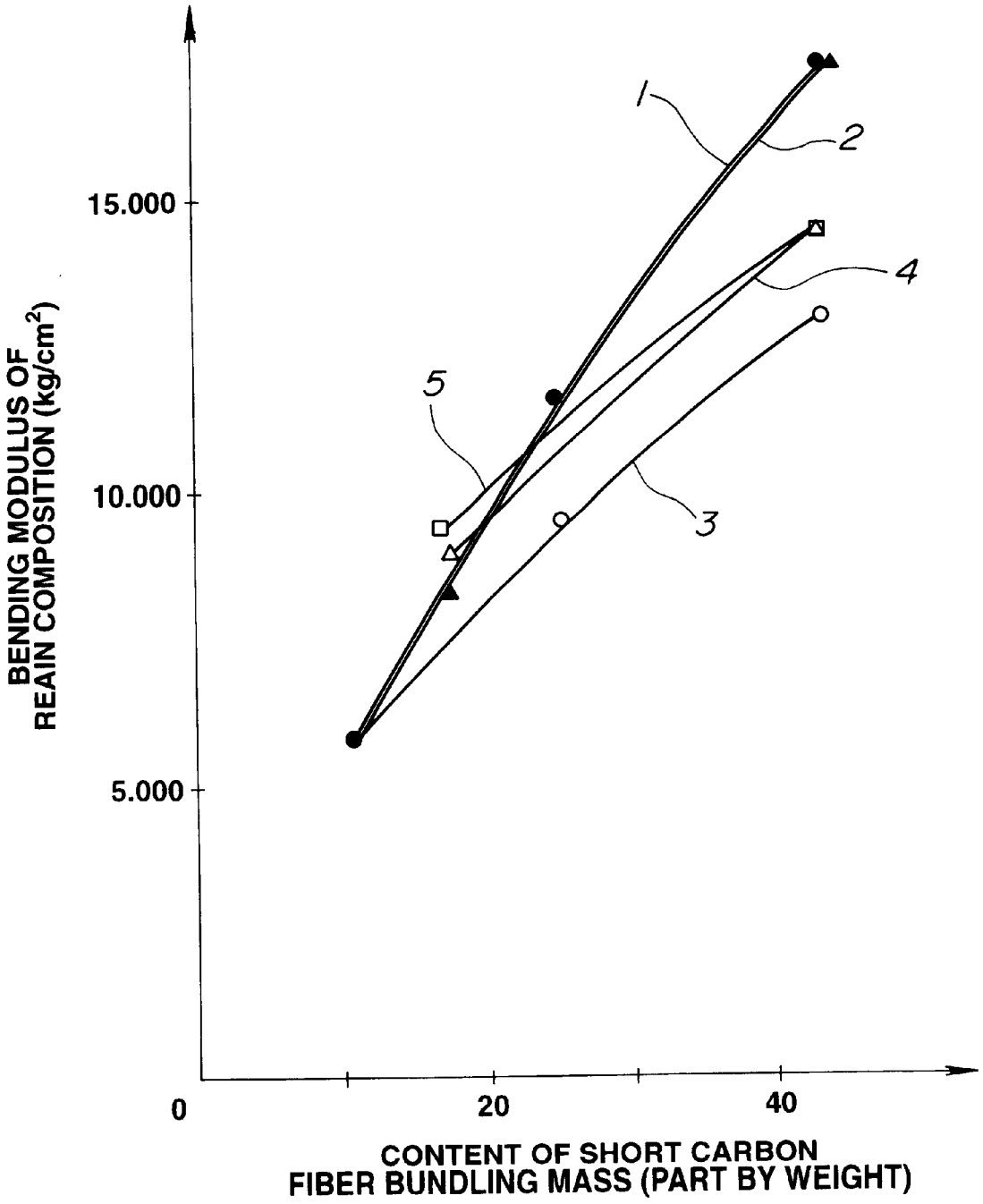

This application is a Division of 08/678/047 filed Aug. 10, 1996.

BACKGROUND OF THE INVENTION

The present invention relates to a short carbon fiber bundling mass mainly used for producing a fiber-reinforced resin composition, a process for producing the short carbon fiber bundling mass, and the fiber-reinforced resin composition containing the short carbon fiber bundling mass. More particularly, the present invention relates to a fiber-reinforced resin composition containing a short carbon fiber bundling mass, which is excellent in rigidity, heat resistance, lightweight ability and moldability, and therefore, is useful as a material in place of a metal diecast material composed of aluminum or the like.

Precision parts have been hitherto produced from metal using a die-casting method in view of a bending modulus, a dimensional accuracy, a heat resistance or the like. Such metal diecast products can be finished with less machining as compared with normal shaved products. However, the diecast products still require considerable machining tasks to form a final product. Since a die used in the die-casting method is exposed to an elevated temperature, it must be formed from an expensive heat-resistant material. In addition, since the diecast method includes a step of melting a metal material, an additional cost is required to install surrounding refractory facilities. Furthermore, it is required to lighten a weight of precision machinery used in the diecast method.

In recent years, particular a fiber-reinforced resin composition produced by mixing and dispersing a carbon fiber in various matrix resins are attracting attention as an industrially important material because of its excellent mechanical properties such as a high mechanical strength, a high rigidity, a low specific gravity, a high impact resistance or the like. Especially, in the fields of the precision parts and electronic parts which have been recently further miniaturized and lightened, the molded products composed of a rigid fiber-reinforced resin composition have been used as the substitute of the metal diecast products. However, the conventional fiber-reinforced resin compositions are still inferior in rigidity and heat resistance as compared with the metal diecast material, resulting in limiting the use of the fiber-reinforced resin composition. For example, though the fiber-reinforced resin composition has a heat resistance capable of withstanding a temperature of about 200° C., a thermal conductivity thereof is still low, thereby causing such disadvantage that high-temperature portions are locally generated due to deteriorated heat flow in the molded product upon use. For this reason, the molded product prepared therefrom cannot yet be sufficiently put into a practical use.

Conventionally, when the fiber-reinforced resin composition is produced by blending and dispersing short carbon fibers in various matrix resins, a number of long carbon fibers are first bundled by using a so-called sizing agent and then the bundled long carbon fibers are cut into short carbon fiber bundling masses, followed by mixing the short carbon fiber bundling masses in the matrix resin to obtain a fiber-reinforced resin composition.

In the case where the fiber-reinforced resin composition is prepared by blending the short carbon fiber bundling mass produced by using the sizing agent, with a matrix resin, especially a matrix resin used under a high temperature condition, the carbon fiber-containing resin composition is subjected to a high-temperature molding process to form a molded product, upon which the resin composition is likely to generate a gas. Such gas generation causes poor environmental conditions. In order to solve the problem, the present inventors have previously proposed, in Japanese Patent Application Laid-open (KOKAI) No. 6-143,483 (1994), a fiber-reinforced resin composition containing a short carbon fiber bundling mass prepared by carbonizing the short carbon fiber mass bundled by using the sizing agent at a temperature of 400 to 1,500° C. In this Japanese Patent KOKAI, there has been no suggestion that, the short carbon fiber bundling mass is treated at a higher temperature than the afore-mentioned temperature range of 400 to 1,500° C.

On the other hand, in the field of such a fiber-reinforced resin composition, in association with an increasing demand for miniaturization and light-weight of the molded product, it is required that a blending ratio of the carbon fiber to the matrix resin is increased as highly as possible to obtain a high-rigidity fiber-reinforced resin material.

However, when a large amount of the conventional short carbon fiber bundling mass or bunched short carbon fiber mass which has been subjected to carbonization treatment, for example, not less than 30 parts by weight of the short carbon fiber bundling mass or bunched short carbon fiber mass are mixed with and dispersed in 100 parts by weight of the matrix resin, various problems are caused so that it is difficult to attain the resin composition having a high carbon fiber content, which become difficult to obtain a fiber-reinforced resin composition having a high rigidity and a high bending modulus because of insufficient dispersion of the carbon fiber in the matrix resin. For instance, when a large amount of the short carbon fiber bundling mass is supplied into a feeder, there occur such a problem that pills or flocks are generated so that clogging is caused in a feeding passage, or it is not possible to uniformly disperse the short carbon fiber in the matrix resin. In addition, it is difficult to obtain a short carbon fiber bundling mass having a high bulk density even though high-modulus carbon fibers are bundled by using a sizing agent.

In the fields where a molded product of a miniaturization and light-weight is required, it is demanded to provide a high-modulus fiber-reinforced resin composition. However, conventionally, even if a large amount of the short carbon fiber bundling mass is incorporated into the matrix resin, it is possible to obtain the molded product exhibiting a high bending modulus at a required level.

Further, it is demanded to provide a short carbon fiber bundling mass having a fiber length of 2 to 20 mm and a bulk density of 450 to 650 g/l.

As a result of the present inventor intense studies to solve the afore-mentioned problems, it has been found that by subjecting bundled short carbon fiber formed by using a sizing agent, to graphitization in an inert gas atmosphere at a maximum temperature ranging from 1600° C. to 3300° C., the obtained short carbon fiber bundling mass composed of short carbon fiber and graphite derived from the resin as the sizing agent, shows a good handing ability in mixing and dispersing processes and a high dispersibility when mixed with a resin material, so that it is possible to incorporate a large amount of carbon fiber in a matrix resin and a resultant resin composition unexpectedly exhibit an extremely high bending modulus and thermal conductivity. The present invention has been attained on the basis of the finding.

SUMMARY OF THE INVENTION

It is an object of the present invention to provide a short carbon fiber bundling mass which is easy to handle, namely has a good handing ability in mixing and dispersing processes and a high dispersibility relative to a resin material, so that it is possible to incorporate a large amount of carbon fiber in a matrix resin, and which has a high bending modulus.

It is another object to provide a fiber-reinforced resin composition capable of exhibiting a high bending modulus, a high bending rigidity as compared with a metal material having the same weight, that is, a high light-weight ability as compared with a metal material having the same bending rigidity, and a good thermal conductivity which is as high as two or more times that of the conventional resin composition.

To accomplish the aims, in a first aspect of the present invention, there is provided a short carbon fiber bundling mass comprising short carbon fibers which are bundled by using a sizing agent and heated to a maximum temperature ranging from 1,600° C. to 3,300° C. in an inert gas atmosphere to conduct graphitization treatment.

In a second aspect of the present invention, there is provided a short carbon fiber bundling mass having a fiber length of 2 to 20 mm and a bulk density of 450 to 650 g/l, said short carbon fiber bundling mass being graphitized.

In a third aspect of the present invention, there is provided a process for producing a short carbon fiber bundling mass comprising the steps of bundling carbon fibers by using a sizing agent, and after cutting, heating the bundled short carbon fiber to a maximum temperature ranging from 1,600° C. to 3,300° C. in an inert gas atmosphere.

In a fourth aspect of the present invention, there is provided a fiber-reinforced resin composition comprising:

not less than 30 parts by weight of a short carbon fiber bundling mass prepared by bundling carbon fibers by using a sizing agent and after cutting, heating the bundled short carbon fibers to a maximum temperature ranging from 1,600° C. to 3,300° C. in an inert gas atmosphere to conduct graphitization treatment, and 100 parts by weight of a thermoplastic resin.

In a fifth aspect of the present invention, there is provided a fiber-reinforced resin composition comprising:

not less than 30 parts by weight of a short carbon fiber bundling mass having a fiber length of 2 to 20 mm and a bulk density of 450 g/l to 650 g/l, said short carbon fiber bundling mass being graphitized, and 100 parts by weight of a thermoplastic resin.

In a sixth aspect of the present invention, there is provided a fiber-reinforced resin composition comprising:

not less than 30 parts by weight of a short carbon fiber having a fiber length of 2 to 20 nmm and a bulk density of 450 g/l to 650 g/l by, and prepared by bundling carbon fibers using a sizing agent and after cutting, heating the bundled short carbon fiber to a maximum temperature ranging from 1,600° C. to 3,300° C. in an inert gas atmosphere to conduct graphitization treatment, and 100 parts by weight of a thermoplastic resin.

BRIEF DESCRIPTION OF THE INVENTION

FIG. 1 is a graph showing a relation between a bending modulus of fiber-reinforced resin compositions of Examples 1 and 2, and Comparative Examples 1 to 3, and a content of a short carbon fiber bundling mass in the resin composition.

DETAILED DESCRIPTION OF THE INVENTION

The present invention is described in detail below.

The term "short carbon fibers" mentioned in the present invention is a concept contrasted with long carbon fibers normally used for the production of prepregs or the like.

Various carbon fibers known in the art can be used in the present invention. Specific examples of the suitable carbon fibers may include polyacrylonitrile-based carbon fibers, rayon-based carbon fibers, pitch-based carbon fibers, polyvinyl alcohol-based carbon fibers, or the like. The especially preferred carbon fibers are pitch-based carbon fibers produced from a mesophase pitch.

The short carbon fiber bundling mass used in the present invention, can be prepared in the following manner. These long carbon fibers are bundled by using the sizing agent and then the resultant bundles of carbon fibers are cut into those normally having a fiber length of 2 to 20 mm, preferably 3 to 12 mm according to known methods. The thus-prepared bundled short carbon fiber is used in the subsequent graphitization processes. Any sizing agents normally used for similar purposes are applicable to the production of bundled short carbon fiber according to the present invention. Among these sizing agents, those capable of effectively bundling monofilamnets are preferably selected. Specific examples of the suitable sizing agents include polymers such as epoxy resin compounds, polyurethane compounds, saturated or unsaturated polyesters, polyphenylene sulfide, polyphenylene ethers, polycarbonates, polyoxy-methylene, polystyrene, polyolefins, acrylic resins, vinyl acetate resin, ethylene-vinyl acetate copolymer, polyamide resins or the like. The especially preferred sizing agents are epoxy resin compounds or water-soluble polyamide compounds.

The sizing agent may be adhered to the carbon fiber in an amount enough to exhibit a fiber-bundling effect of the sizing agent. Specifically, the amount of the sizing agent adhered may be in the range of 0.1 to 10% by weight, preferably 0.5 to 7% by weight based on the total weight of the carbon fiber. If the amount of the sizing agent adhered is less than 0.1% by weight, the carbon fibers cannot be sufficiently bundled together. On the other hand, if the amount of the sizing agent adhered is more than 10% by weight, the short carbon fibers have a low dispersibility in the matrix resin because a bundling property thereof becomes too high, so that the physical properties of the resultant carbon fiber-reinforced thermoplastic resin composition may be deteriorated.

Any known methods are used to bundle the short carbon fibers by using the sizing agent. For example, several hundreds to several hundred-thousands of bundles of long carbon fibers can be impregnated with the sizing agent and then dried and cut. In this case, the impregnation of the long carbon fibers with the sizing agent can be performed using a solution obtained by dissolving the sizing agent in a solvent, an emulsion obtained by dispersing the sizing agent in a solvent, a melt obtained by heat-fusing the sizing agent, or the like. However, in the case where the melt of the sizing agent is used, it is difficult to remove the adhered sizing agent from the carbon fiber because of a high viscosity thereof, so that it may become difficult to adjust the amount of the sizing agent adhered to the carbon fiber. Further, in such a method, the sizing agent is apt to suffer from heat deterioration, which adversely affects physical properties such as a heat resistance of the resultant resin composition as a whole.

The sizing agent used in the present invention can be dissolved or dispersed in a solvent as described above. In this case, examples of the suitable solvents include 2-butanone, tetrahydrofuran, N, N-dimethylformamide, acetone, chloroform, dichloromethane alcohol, water or the like.

The solution or emulsion containing the sizing agent may contain other additives such as surfactants, silane-based coupling agents, epoxy-based hardening agents, catalysts, adhesives or the like, if required.

As the surfactants suitably used for dispersing the sizing agent in the emulsion, at least one compound selected from the group consisting of polyoxy-ethylene alkyl ethers or polyoxy ethylene alkylaryl ethers such as castor oil ether of polyoxymethylene, polyoxymethylene-nonylphenyl ether or polyoxymethylene-styrenated phenyl ether, and polyvinyl alcohol may be exemplified.

Next, the conditions for carrying out the graphitization of the bundled short carbon fiber formed by using the sizing agent, is now described below. The graphitization of the bundled short carbon fiber can be carried out in an inert gas atmosphere, in vacuum or in graphite breeze so as to keep the bundled short carbon fiber out of contact with air. During the graphitization, the bundled short carbon fiber is heated to a maximum temperature ranging from 1,600° C. to 3,300° C., preferably from 1,800° C. to 3,300° C, more preferably from 2,000° C. to 3,300° C.

The rate of temperature rising used for heating the bundled short carbon fiber to the maximum temperature during the graphitization is not particularly restricted. The heating may be normally conducted at a temperature rising rate ranging from 0.1° C./hour to 200° C./hour, preferably 5° C./hour to 200° C./hour. Alternatively, the bundled short carbon fiber can be first heated for a carbonization treatment thereof at a temperature of 400° C. to 1,500° C. and then subjected to the afore-mentioned graphitization treatment in the same thermal treatment apparatus or after transferring the carbonized bundled short carbon fiber in a separate graphitization treatment apparatus. It is preferred that the graphitization treatment be conducted at an oxygen concentration of not more than 500 ppm. If the oxygen concentration is more than 500 ppm, the carbonized short carbon fiber to be treated is likely to suffer from an oxidative damage.

The graphitization treatment is performed by controlling the conditions so as to form an appropriate amount of a graphite crystal on the resultant short carbon fiber bundling mass. The formation of the graphite crystal may be ascertained by determining whether a value of interplanar spacing (d002), which can be normally measured according an X-ray powder method, is in the range of 3.36 Å to 3.45 Å, preferably 3.36 Å to 3.43 Å. The formation of the graphite crystal may be ascertained by using any method other than the X-ray powder method, as far as the value of the interplanar spacing (d002) can be measured, for example, by using a high-resolution transmission electron microscope or by using an electron diffraction method.

In addition, it is preferred that the short carbon fiber used in the present invention has a tensile modulus of not less than 50 T/mm$^2$. The tensile modulus of the short carbon fiber can be measured as follows. The long carbon fiber is prepared in the same manner as described above except that the cutting of the carbon fiber is not conducted. The thus-prepared long carbon fiber is subjected to a tensile test to measure the tensile modulus, whereby a tensile modulus of the corresponding short carbon fiber can be determined.

The short carbon fiber bundling mass used in the present invention has a bulk density of 450 g/l to 650 g/l, preferably 550 g/l to 650 g/l.

In addition, the short carbon fiber bundling mass used in the present invention exhibits a weight loss of not more than 0.5% when heated in an inert gas atmosphere at 400° C. under one atom for one hour. This indicates that the short carbon fiber bundling mass is hardly decomposed by heating upon molding, so that only an extremely small amount of gas is generated therefrom.

Further, the short carbon fiber bundling mass used in the present invention has a low content of ash as impurities. The ash content is not more than 100 ppm, preferably not more than 50 ppm. Incidentally, the ash content is determined by measuring a weight of a residual unburned ash component generated when the carbon fiber is burned in air at a temperature of not less than 800° C. for a period of time sufficient to burn out a carbon element, for example, for not less than 300 minutes.

Next, the fiber-reinforced resin composition in which the afore-mentioned short carbon fiber bundling mass is used as a reinforcing material, is described below.

The resin used in the present invention may be any known resins, preferably thermoplastic resins. Examples of the suitable thermoplastic resins include polymers such as polycarbonates, polystyrene, polyesters, polyolefins, acryl resins, polyoxymethylene, polyphenylene ethers, polyphenylene oxide, polybutylene-terephthalate, polyethers-ether ketones, polyphenylene sulfone, fluororesin, or copolymers thereof. Especially, when heat-resistant super-engineering plastics which have conventionally posed a serious problem in which a gas is generated due to its high molding temperature, is used as the matrix resin of the present invention, a considerably large effect can be obtained by the use of the short carbon fiber bundling mass according to the present invention. Any conventionally known heat-resistant super-engineering plastics may be used in the present invention. Examples of the preferred heat-resistant super-engineering plastics may include polyether-ether ketones, polyether ketones, polyetherketone-ketones, polyether sulfone, polyphenylene sulfide, polyarylene-sulfides, polyether-imides, polyimides, polyarylates, polysulfones, polyamide-imides, liquid crystal polymers or a mixture thereof, though not particularly limited thereto.

Further, there can be suitably used crystalline resins, e.g., polyamides, acrylonitrile-styrene (AS) resins, polyphenylene sulfide, liquid crystal polymers (LCP) or a mixture thereof because these resins can retain a moldability even when the carbon fiber is highly filled therein.

The fiber-reinforced resin composition according to the present invention is a mixture of the afore-mentioned components. The amount of the short carbon fiber bundling mass blended is in the range of 30 to 280 parts by weight, preferably 40 to 250 parts by weight based on 100 parts by weight of the matrix resin. If the amount of the short carbon fiber bundling mass blended is less than 30 parts by weight based on 100 parts by weight of the matrix resin, a reinforcing effect by the addition of the short carbon fiber bundling mass cannot be sufficiently exhibited. On the other hand, if the amount of the short carbon fiber bundling mass blended is more than 280 parts by weight, various problems are likely to occur upon mixing and dispersing the short carbon fiber bundling mass in the matrix resin.

The fiber-reinforced resin composition according to the present invention has preferably a bending modulus of not less than 150,000 kg/cm$^2$, a specific volume resistance of not more than 100 Ω·cm, a thermal conductivity of not less than 0.7 W/mK in the direction perpendicular to the orientation of the short carbon fiber, and a thermal conductivity of not less than 4 W/mK in the direction parallel with the orientation of the short carbon fiber.

The blending of the short carbon fiber bundling mass with the matrix resin is not particularly limited, but can be normally performed by using a single screw extruder, a twin screw extruder, a pressing machine, a high-speed mixer, an injection molding machine, a pultrusion machine or the like.

Further, other components or additives can be added to the fiber-reinforced resin composition, unless the effects and advantages achieved by the present invention are not adversely affected by the addition thereof. Examples of such components or additives include reinforcing material composed of short or long fibers such as other kinds of carbon fibers, a glass fiber, an aramid fiber, a boron fiber and a silicon carbide fiber, whiskers, fibrous reinforcing materials coated with metal such as nickel, aluminum, copper or the like, or fillers such as carbon black, molybdenum disulfide, mica, talc or calcium carbonate, and the additives such as a stabilizing agent, a lubricant or the like.

A large amount of the short carbon fiber bundling mass according to the present invention can be blended with the matrix resin, so that a high bending modulus can be obtained. In addition, the short carbon fiber bundling mass itself exhibits a good retention of its bundled form and is, therefore, easily handled. In the preparation of the fiber-reinforcing resin composition, such a short carbon fiber bundling mass can be readily blended with and dispersed in the matrix resin with a improved operability. Furthermore, upon molding of the resin composition, almost no gas is generated even when the resin composition is heated to an elevated temperature, whereby a molded product with few voids can be obtained.

In the process for the preparation of the short carbon fiber bundling mass according to the present invention, the short carbon fiber bundling mass having such excellent properties can be produced in a facilitated and industrially advantageous manner.

The fiber-reinforced resin composition has an extremely small amount of generated voids and exhibits excellent mechanical properties. In addition, the fiber-reinforced resin composition has a high carbon fiber content and a high bending modulus (high rigidity), so that the resultant molded product can exhibit a high rigidity as compared with that of an aluminum alloy having the same weight and can have a high lightweight ability as compared with that of an aluminum alloy having the same rigidity. Furthermore, local high-temperature portions are not formed due to its high thermal conductivity, whereby a heat-resistant fiber-reinforced resin composition capable of withstanding an elevated temperature upon a practical use, can be obtained.

EXAMPLES

The present invention is described in more detail by way of examples. However, the examples are only illustrative and therefore the present invention is not limited to the examples.

Example 1

(I) Preparation of short carbon fiber bundling mass:

A pitch-based carbon fiber having a tensile strength of 240 kg/mm$^2$, a tensile modulus of 22 ton/mm$^2$, a fiber diameter of 10 $\mu$m, a density of 2.01 g/cm$^3$ and number of filaments of 8,000, was impregnated in an aqueous emulsion having a concentration of 3% by weight prepared by dispersing in water a sizing agent composed of 60 parts by weight of an epoxy resin compound "Epicoat 834" produced by Shell Chemical Co., Ltd. and 40 parts by weight of an epoxy resin compound "Epicoat 1004" produced by Shell Chemical Co., Ltd. Thereafter, the resultant carbon fiber was heated and dried at about 120° C. for 20 minutes and then cut into bundled short carbon fiber having a fiber length of 6 mm (the amount of the sizing agent adhered being 3.1% by weight), by means of a cutting machine. The thus-obtained bundled short carbon fiber were heated to 2000° C. in an argon gas atmosphere for one hour and then be cooled to produce a graphitized short carbon fiber bundling mass. The thus-produced short carbon fiber bundling mass had a bulk density of 610 g/l and an ash content of 67 ppm when burned at 880° C. for 40 hours in air.

In addition, the short carbon fiber bundling mass was subjected to a powder X-ray diffraction measurement (according to a method for measuring a lattice constant and a crystallite of a synthetic graphite, prescribed by a committee No. 117 for a carbonaceous material which is organized by Nippon Gijutsu Shinkohkai), by using a silicon standard specimen. The short carbon fiber bundling mass had a graphite interplanar spacing (d002) of 3.42 Å.

In order to measure a tensile modulus of the short carbon fiber bundling mass, the procedure was repeated in the same manner as described above except that cutting of the bundled carbon fibers was omitted, so that the long carbon fiber bundling mass were prepared. (It was difficult to measure a tensile modulus of the short carbon fiber bundling mass by the current measuring methods). The thus-prepared bundled long carbon fibers had a tensile modulus of 60 ton/mm$^2$.

(II) Preparation of fiber-reinforced resin composition:

Forty three parts by weight of the short carbon fiber bundling mass prepared above was dry-blended with 100 parts by weight of dry pellets of a polybutylene-terephthalate resin ("NOVADOWL" produced by Mitsubishi Engineering Plastics Co., Ltd.). The resultant mixture was then charged into a screw extruder, and intimately mixed and melted at 250° C. so as to be extruded into strands. After water-cooling, the extruded strands were cut into pellets. In the course of the afore-mentioned process, the charging of the carbon fiber-containing resin mixture into the extruder was smoothly carried out, almost no gas generation was observed during the pelletization, and the resultant mixture of the short carbon fiber bundling mass and the matrix resin exhibited a uniform dispersion. The thus-prepared short carbon fiber-reinforced molding material was dried at 120° C. for 6 hours and then injection-molded to prepare a test specimen (A).

Separately, the afore-mentioned procedure was repeated in the same manner except that 25 parts by weight (specimen B) and 11 parts by weight (specimen C) of the short carbon fiber bundling mass were blended with 100 parts by weight of the polybutylene-terephthalate resin pellets to prepare test specimens B and C, respectively.

The moldability and bending modulus of the thus-prepared test specimens A to C were measured. The results are shown in Table 1 and FIG. 1. In FIG. 1, the bending modulus of the fiber-reinforced resin composition obtained in Example 1 is indicated by the curve 1. Incidentally, the bending modulus of the test specimens were carried out according to ASTM D790. also, all the bending modulus mentioned throughout the subsequent examples and comparative examples were also measured according to ASTM D790.

Comparative Example 1

(I) Preparation of short carbon fiber bundling mass:

The same manner as in Example 1 is conducted to prepare a short carbon fiber bundling mass, except that the carbon fibers bundled by the sizing agent were not graphitized.

The thus-prepared short carbon fiber bundling mass had a bulk density of 580 g/l and an ash content of 200 ppm when burned at 880° C. for 40 hours in air.

In addition, the obtained short carbon fiber bundling mass was subjected to a powder X-ray diffraction measurement (according to a method for measuring a lattice constant and a crystallite of a synthetic graphite, prescribed by a committee No. 117 for a carbonaceous material which is organized by Nippon Gijutsu Shinkohkai), by using a silicon standard specimen. The short carbon fiber bundling mass had a graphite interplanar spacing (d002) of 3.47 Å.

(II) Preparation of fiber-reinforced resin composition:

The same manner as in Example 1 is conducted except that the short carbon fiber bundling mass prepared above was used. As a result, there were prepared 3 types of test specimens (a), (b) and (c) which contained 43 parts by weight (specimen a), 25 parts by weight (specimen b) and 11 parts by weight (specimen c) of the obtained short carbon fiber bundling mass, respectively, based on 100 parts by weight of the polybutylene-terephthalate resin pellets.

The moldability and bending modulus of the thus-prepared test specimens were measured. The results are also shown in Table 1 and FIG. 1. In FIG. 1, the bending modulus of the fiber-reinforced resin composition obtained in Comparative Example 1 is indicated by the curve 3.

Example 2

Forty three parts by weight of the short carbon fiber bundling mass prepared in Example 1 was dry-blended with 100 parts by weight of dry polyether-imide resin pellets "ULTEM 1010" produced by Japan G. E. Plastics Co., Ltd. The resultant mixture was charged into a screw extruder, and was intimately mixed and melted at 390° C. therein so as to be extruded into strands. The extruded strands were cooled with water and cut into pellets. In the course of the afore-mentioned process, the charging of the mixture into the screw extruder was smoothly carried out, almost no gas generation was observed during the pelletization and the resultant mixture of the short carbon fiber bundling mass and the matrix resin exhibited a uniform dispersion. The thus-obtained short carbon fiber-reinforced molding material was dried at 120° C. for 6 hours and then injection-molded to prepare a test specimen (D).

Further, the afore-mentioned procedure was repeated in the same manner except that 17 parts by weight of the short carbon fiber bundling mass was blended with 100 parts by weight of the polyether-imide resin pellets to prepare a test specimen (E).

The moldability and bending modulus of the test specimens (D) and (E) were measured. The results are also shown in Table 1 and FIG. 1. In FIG. 1, the bending modulus of the fiber-reinforced resin composition obtained in Example 2 is indicated by the curve 2.

Comparative Example 2

(I) Preparation of short carbon fiber bundling mass:

The carbon fibers used in Example 1 were bundled by using the same sizing agent as used in Example 1 and then the bundled carbon fibers were cut into those having a fiber length of 6 mm. The cut bundled carbon fiber was subjected to a carbonization treatment at a maximum temperature of 400° C. to prepare a short carbon fiber bundling mass.

That is, the preparation of the short carbon fiber bundling mass was carried out in the following manner.

A pitch-based carbon fiber having a tensile strength of 240 kg/mm$^2$, a tensile modulus of 22 ton/mm$^2$, a fiber diameter of 10 $\mu$m, a density of 2.01 g/cm$^3$ and number of filaments of 8,000, was impregnated in an aqueous emulsion having a concentration of 3% by weight prepared by dispersing in water a sizing agent composed of 60 parts by weight of an epoxy resin compound "Epicoat 834" produced by Shell Chemical Co., Ltd. and 40 parts by weight of an epoxy resin compound "Epicoat 1004" produced by Shell Chemical Co., Ltd. Thereafter, the emulsion-impregnated carbon fiber was heated and dried at about 120° C. for 20 minutes and then cut into short carbon fiber bundling mass having a fiber length of 6 mm (the amount of the sizing agent adhered being 3.1% by weight), by means of a cutting machine. The thus-prepared bundled short carbon fiber was heated to 400° C. in an argon gas atmosphere for one hour and then be cooled to obtain a short carbon fiber bundling mass. The resultant short carbon fiber bundling mass had a bulk density of 590 g/l and an ash content of 200 ppm when burned at 880° C. for 40 hours in air.

In addition, the short carbon fiber bundling mass was subjected to a powder X-ray diffraction measurement (according to a method for measuring a lattice constant and a crystallite of a synthetic graphite, prescribed by a committee No. 117 for a carbonaceous material which is organized by Nippon Gijutsu Shinkohkai), by using a silicon standard specimen. The short carbon fiber bundling mass had a graphite interplanar spacing (d002) of 3.47 Å.

(II) Preparation of fiber-reinforced resin composition:

The same manner as in Example 2 was conducted except that the blending ratio of the obtained short carbon fiber bundling mass to the polyether-imide resin pellets was changed. As a result, there were prepared 2 types of test specimens (d) and (e) which contained 43 parts by weight (specimen d) and 17 parts by weight (specimen e) of the short carbon fiber bundling mass, respectively, based on 100 parts by weight of the polyetherimide resin pellets.

The moldability and bending modulus of the thus-prepared test specimens were measured. The results are also shown in Table 1 and FIG. 1. In FIG. 1, the bending modulus of the fiber-reinforced resin composition obtained in Comparative Example 2 is indicated by the curve 4.

Comparative Example 3

(I) Preparation of short carbon fiber bundling mass:

The carbon fibers prepared in Example 1 were bundled by using the same sizing agent as used in Example 1 and then the bundled carbon fibers were cut into those having a fiber length of 6 mm. The cut bundled carbon fibers were subjected to a carbonization treatment at a maximum temperature of 1,000° C. in argon gas atmosphere to prepare a final short carbon fiber bundling mass.

That is, the preparation of the short carbon fiber bundling mass was carried out in the following manner.

A pitch-based carbon fiber having a tensile strength of 240 kg/mm$^2$, a tensile modulus of 22 ton/mm$^2$, a fiber diameter of 10 $\mu$m, a density of 2.01 g/cm$^3$ and number of filaments of 8,000, was impregnated in an aqueous emulsion having a concentration of 3% by weight prepared by dispersing in water a sizing agent composed of 60 parts by weight of an epoxy resin compound "Epicoat 834" produced by Shell Chemical Co., Ltd. and 40 parts by weight of an epoxy resin compound "Epicoat 1004" produced by Shell Chemical Co., Ltd. Thereafter, the emulsion-impregnated carbon fiber was heated and dried at about 120° C. for 20 minutes and then cut into short carbon fiber bundling mass having a fiber length of 6 mm (the amount of the sizing agent adhered being 3.1% by weight), by means of a cutting machine. Successively, the thus-prepared bundled short carbon fiber was heated to 1,000° C. in an argon gas atmosphere for one hour and then be cooled to prepare a short carbon fiber bundling mass. The resultant short carbon fiber bundling mass had a bulk density of 590 g/l and an ash content of 180 ppm when burned at 880° C. for 40 hours in air.

In addition, the short carbon fiber bundling mass was subjected to a powder X-ray diffraction measurement (according to a method for measuring a lattice constant and a crystallite of a synthetic graphite, prescribed by a committee No. 117 for a carbonaceous material which has been organized by Nippon Gijutsu Shinkohkai), by using a silicon standard specimen. The short carbon fiber bundling mass had a graphite interplanar spacing (d002) of 3.47 Å.

(II) Preparation of fiber-reinforced resin composition:

The same manner as in Example 2 was conducted except that the blending ratio of the short carbon fiber bundling mass to the polyether-imide resin pellets was changed. As a result, there were prepared 2 types of test specimens (d') and (e') which contained 43 parts by weight (specimen d') and 17 parts by weight (specimen e') of the short carbon fiber bundling mass, respectively, based on 100 parts by weight of the polyetherimide resin pellets.

The moldability and bending modulus of the thus-prepared test specimens (d') and (e') were measured. The results are also shown in Table 1 and FIG. 1. In FIG. 1, the bending modulus of the fiber-reinforced resin composition obtained in Comparative Example 3 is indicated by the curve 5.

TABLE 1

| Example No. | Specimen | Amount of short carbon fiber bundling mass (parts by weight) | Moldability (blendability and dispersibility) | Bending modulus (kg/cm$^2$) |
|---|---|---|---|---|
| Example 1 | A | 43 | good | 172,000 |
| | B | 25 | good | 114,000 |
| | C | 11 | good | 59,000 |
| Comparative Example 1 | a | 43 | poor | 130,000 |
| | b | 25 | good | 96,000 |
| | c | 11 | good | 59,000 |
| Example 2 | D | 43 | good | 172,000 |
| | E | 17 | good | 82,000 |
| Comparative Example 2 | d | 43 | poor | 146,000 |
| | e | 17 | good | 90,000 |
| Comparative Example 3 | d' | 43 | poor | 146,000 |
| | e' | 17 | good | 92,000 |

Example 3

The short carbon fiber bundling mass prepared in Example 1 was dry-blended with a polyphenylene sulfide (PPS) resin produced by Mitsubishi Engineering Plastics Co., Ltd. The blending percentage of the short carbon fiber bundling mass was 45% by weight based on the total weight of the resultant resin composition. (The amount of the short carbon fiber bundling mass was 82 parts by weight based on 100 parts by weight of the matrix resin.)

The resultant mixture was charged into a twin-screw extruder through a hopper thereof and intimately mixed therein so as to be extruded into strands. The extruded strands were cooled while drawing from the extruder and then cut into pellets by means of a strand cutter. The thus-prepared pellets were melted and injection-molded to prepare a test specimen. The bending modulus, a specific volume resistance and thermal conductivity of the thus-prepared test specimen were measured. The results are shown in Table 2.

Example 4

The same manner as in Example 3 was conducted to prepare a test specimen except that the blending percentage of the short carbon fiber bundling mass was 60% by weight based on the total weight of the resultant resin composition. (The amount of the short carbon fiber bundling mass was 150 parts by weight based on 100 parts by weight of the matrix resin.) The thus-prepared test specimen was tested in the same manner as described in Example 3. The results are also shown in Table 2.

Example 5

The same manner as in Example 3 was conducted to prepare a test specimen, except that the short carbon fiber bundling mass was fed into the twin-screw extruder through a side feed opening thereof while the PPS matrix resin was fed into the extruder through a top feed opening thereof. The thus-prepared test specimen was tested in the same manner as described in Example 3. The results are also shown in Table 2.

Example 6

The same manner as in Example 3 was conducted to prepare a test specimen except that the blending percentage of the short carbon fiber bundling mass was 30 % by weight based on the total weight of the resultant resin composition. (The amount of the short carbon fiber bundling mass was 43 parts by weight based on 100 parts by weight of the matrix resin.) The thus-prepared test specimen was tested in the same manner as described in Example 3. The results are also shown in Table 2.

Comparative Example 4

The same manner as in Example 3 was conducted to prepare a test specimen except that the blending percentage of the short carbon fiber bundling mass was 15% by weight based on the total weight of the resultant resin composition. (The amount of the short carbon fiber bundling mass was 18 parts by weight based on 100 parts by weight of the matrix resin.) The thus-prepared test specimen was tested in the same manner as described in Example 3. The results are also shown in Table 2.

Comparative Example 5

The same manner as in Example 3 was conducted to prepare a test specimen except that the blending percentage of the short carbon fiber bundling mass was 75% by weight based on the total weight of the resultant resin composition. (The amount of the short carbon fiber bundling mass was 300 parts by weight based on 100 parts by weight of the matrix resin.) The thus-prepared test specimen was tested in the same manner as described in Example 3. The results are also shown in Table 2. Further, even when the carbon fiber and the matrix resin were intimately mixed with each other, any uniform mixture could not be obtained.

Comparative Example 6

The same manner as in Example 3 was conducted to prepare a test specimen, except that the short carbon fiber bundling mass prepared in Comparative Example 1 was used. The thus-prepared test specimen was tested in the same manner as described in Example 3. The results are also shown in Table 2. Further, when the carbon fiber and the matrix resin were intimately mixed with each other, a considerable amount of gas was generated and any uniform mixture could not be obtained.

Comparative Example 7

The same manner as in Example 3 was conducted to prepare a test specimen, except that the short carbon fiber bundling mass which was carbonized at 400° C. in Comparative Example 2 was used in an amount of 60% by weight based on the total weight of the resultant resin composition. The thus-prepared test specimen was tested in the same manner as described above. The results are also shown in Table 2. Further, when the carbon fiber and the matrix resin were intimately mixed with each other, any uniform mixture could not be obtained.

TABLE 2

| Example No. | Tensile modulus of carbon fiber used (T/mm$^2$) | Content of carbon fiber (wt %) | Bending modulus (T/mm$^2$) | Specific gravity (g/cm$^3$) |
|---|---|---|---|---|
| Example 3 | 60 | 45 | 2.7 | 1.62 |
| Example 4 | 60 | 60 | 4.2 | 1.72 |
| Example 5 | 60 | 45 | 3.2 | 1.62 |
| Example 6 | 60 | 30 | 1.6 | 1.52 |
| Comparative Example 4 | 60 | 15 | 0.8 | 1.43 |
| Comparative Example 5 | 60 | 75 | — | — |
| Comparative Example 6 | 22 | 60 | — | — |
| Comparative Example 7 | 22 | 60 | — | — |
| PPS resin | — | — | 0.4 | 1.34 |

| Example No. | Specific volume (Ω · cm) | Thermal conductivity in (W/mA) | Thermal conductivity in (W/mA) |
|---|---|---|---|
| Example 3 | 8 | 1.0 | 8.3 |
| Example 4 | 3 | 1.3 | 13.5 |
| Example 5 | 4 | 1.1 | — |
| Example 6 | 50 | 0.7 | 4.1 |
| Comparative Example 4 | $8 \times 10^5$ | 0.5 | 1.3 |
| Comparative Example 5 | — | — | — |
| Comparative Example 6 | — | — | — |
| Comparative Example 7 | — | — | — |
| PPS resin | $9 \times 10^{15}$ | 0.3 | — |

In Table 2, an tensile modulus of the carbon fiber was measured according to JIS R7601 by using a single filament, and a specific volume resistance thereof was measured according to SRIS 2301 ("SRIS" means "The Society of Rubber Industry Standard in Japan"). The "thermal conductivity in the A direction" means a value of a thermal conductivity measured in the direction of thickness of a tensile specimen which is cut from a central portion of an ASTM tensile specimen, namely in the direction perpendicular to the orientation of the fiber in the tensile specimen. Also, the thermal conductivity in the B direction means a value of a thermal conductivity measured in the longitudinal direction of a tensile specimen prepared by cutting a central portion of four sheet-like ASTM tensile specimens bonded with each other, namely in the direction parallel with the orientation of the fiber in the tensile specimen. Both the thermal conductivity in the A and B directions were measured according to a laser-flash method (JIS R1611).

Further, the results shown in Table 2 were further examined by using sheet-like test specimens having the same weight to compare bending rigidities thereof with each other. The results are shown in Table 3. In Table 3, there is also shown the results from a metal specimen composed of a typical aluminum alloy (2014, bending modulus: 7.4 ton/cm$^2$ and specific gravity: 2.8 g/cm$^2$). As apparently seen from Table 3, in the case where the respective test specimens had the same weight, the test specimens composed of the resin compositions prepared in Examples according to the present invention were found to have a larger thickness as compared with that of the metal specimen. 2014 because the former had a small specific gravity.

The bending rigidity of a plate material is generally represented by the product of a bending modulus and a second moment of area. Further, the second moment of area is in proportion to the cube of a thickness of the plate material. In view of these facts, plate thickness required to obtain the same bending rigidity and ratios of the weights required therefor are shown in Table 4. As appreciated from Table 4, in order to attain the given bending rigidity, the resin compositions prepared in Examples according to the present invention had a smaller weight than that of the aluminum alloy, resulting in producing a high-rigidity molded product having a reduced weight. In addition, The resin composition according to the present invention could exhibit a thermal conductivity two or more times that of the conventional resin composition.

TABLE 3

| Example No. | Ratio of plate thickness with the same weight | Ratio of second moment of area | Ratio of bending rigidity |
|---|---|---|---|
| aluminum alloy 2014 | 1 | 1 | 7.4 |
| Example 3 | 1.73 | 1.5 | 13.7 |
| Example 4 | 1.63 | 4.3 | 18.0 |
| Example 5 | 1.73 | 5.1 | 16.3 |
| Example 6 | 1.84 | 6.2 | 9.9 |
| Comparative Example 4 | 1.95 | 7.4 | 5.9 |

(NOTE) The Ratio of the bending rigidity = (bending modulus) × (ratio of second moment of area)

TABLE 4

| Example No. | Ratio of plate thickness with the same bending rigidity | Weight ratio required | Increase (or decrease) in weight (%) |
|---|---|---|---|
| aluminum alloy 2014 | 1 | 2.8 | 0 |
| Example 3 | 1.40 | 2.27 | −19 |
| Example 4 | 1.21 | 2.08 | −26 |
| Example 5 | 1.32 | 2.14 | −24 |
| Example 6 | 1.67 | 2.53 | −10 |
| Comparative Example 4 | 2.10 | 3.00 | +7 |

What is claimed is:

1. A short carbon fiber bundling mass comprising short carbon fibers bundled by using a sizing agent and heated to a maximum temperature ranging from 1,600° C. to 3,300° C. in an inert gas atmosphere.

2. A short carbon fiber bundling mass having a fiber length of 2 to 20 mm and a bulk density of 450 to 650 g/l, said short carbon fiber bundling mass being graphitized.

3. A short carbon fiber bundling mass according to claim 1, wherein said short carbon fibers has a fiber length of 2 to 20 mm, said short carbon fiber bundling mass has a bulk density of 450 to 650 g/l.

4. The short carbon fiber bundling mass according to claim 1 or 2, wherein a content of ash contained as impurities in said short carbon fiber bundling mass is not more than 100 ppm.

5. The short carbon fiber bundling mass according to claim 1 or 2, wherein a graphite interplanar spacing (d002)

of said short carbon fiber bundling mass is in the range of 3.45 Å to 3.36 Å when measured according to a powder X-ray diffraction method.

6. A process for producing a short carbon fiber bundling mass comprising:

bundling carbon fibers by using a sizing agent; and after cutting, heating the bundled short carbon fibers to a maximum temperature ranging from 1,600° C. to 3,300° C. in an inert gas atmosphere to graphitize the bundled short carbon fibers.

7. The process according to claim 6, wherein said maximum temperature is in the range of 1,800° C. to 3,300° C.

8. A fiber-reinforced resin composition comprising:

not less than 30 parts by weight of a short carbon fiber bundling mass comprising short carbon fibers bundled using a sizing agent and heated/graphitized to a maximum temperature ranging from 1,600° C. to 3,300° C. in an inert gas atmosphere, said short carbon fibers having a fiber length of 2 to 20 mm and a bulk density of 450 to 650 g/l, wherein a ratio of fiber length to fiber diameter of said short carbon fiber (aspect ratio) is 200 to 2000, and 100 parts by weight of a thermoplastic resin.

9. The fiber-reinforced resin composition according to claim 8, wherein a content of ash contained as impurities in said short carbon fiber bundling mass is not more than 100 ppm.

10. The fiber reinforced resin composition according to claim 8, wherein said short carbon fiber bundling mass has a graphite interplanar spacing (d002) ranging from 3.45 Å to 3.36 Å when measured according to a powder x-ray diffraction method.

11. The fiber reinforced resin composition according to claim 8, wherein a bending modulus of said fiber-reinforced resin composition is not less than 150,000 kg/cm$^2$.

12. The fiber-reinforced resin composition according to claim 8, wherein a specific volume resistance of said fiber-reinforced resin composition is not more than 100 Ω·cm.

13. The fiber-reinforced resin composition according to claim 8, wherein a thermal conductivity of said fiber-reinforced resin composition is not less than 0.7 W/mK when measured in the direction perpendicular to the orientation of the short carbon fibers.

14. The fiber-reinforced resin composition according to claim 8, wherein a thermal conductivity of said fiber-reinforced resin composition is not less than 4 W/mK when measured in the direction parallel to orientation of the short carbon fibers.

* * * * *